US006902594B2

(12) United States Patent
Cho

(10) Patent No.: US 6,902,594 B2
(45) Date of Patent: Jun. 7, 2005

(54) INDUSTRIAL DUST-COLLECTOR

(76) Inventor: Kuo-Chin Cho, Floor 2, No. 7, Alley 46, Lane 478, Section 1, An Ho Road, Tainan (TW)

( * ) Notice: Subject to any disclaimer, the term of this patent is extended or adjusted under 35 U.S.C. 154(b) by 0 days.

(21) Appl. No.: 10/683,402

(22) Filed: Oct. 14, 2003

(65) Prior Publication Data

US 2005/0076624 A1 Apr. 14, 2005

(51) Int. Cl.[7] ..... B01D 46/00

(52) U.S. Cl. ..... 55/373; 55/375; 55/378; 55/DIG. 2; 55/DIG. 3; 95/273; 15/314; 15/315; 15/347; 15/348; 15/349; 15/353

(58) Field of Search ..... 55/373, 375, 378, 55/DIG. 2, DIG. 3; 95/273; 15/314, 315, 347, 348, 349, 353

(56) References Cited

U.S. PATENT DOCUMENTS 4,929,261 A * 5/1990 Jacobson ..... 96/403
4,993,107 A * 2/1991 Zoni ..... 15/352
5,507,859 A * 4/1996 Kaiser ..... 95/273
6,146,434 A * 11/2000 Scalfani et al. ..... 55/334
6,342,084 B1 * 1/2002 Pezzaniti ..... 55/361
6,502,274 B1 * 1/2003 Harrelson, II ..... 15/314
6,560,816 B1 * 5/2003 Harrelson, II ..... 15/314

* cited by examiner

*Primary Examiner*—Minh-Chau T. Pham
(74) *Attorney, Agent, or Firm*—Rosenberg, Klein & Lee

(57) ABSTRACT

An industrial dust-collector is provided with an air blower in the bottom of the base. An air-inlet line and an air-out line are provided at the front of the air blower. A cover is provided on the top of the base, a sucking pipe is provided at the top of the cover, and both sides of the cover are respectively provided with a buckle article. A door and a pushing rod are provided at the exterior of the base. An air-guiding block is provided in the bottom of the cover, a plurality of air-guiding holes are provided in the bottom of the air-guiding block, an elastic ring is provided at the bottom of the air-guiding block to secure the top section of a dust-collecting bag and a sleeve tube, and a plurality of through holes are provided around the sleeve tube.

9 Claims, 8 Drawing Sheets

INDUSTRIAL DUST-COLLECTOR

BACKGROUND OF THE INVENTION

1. Field of the Invention

The present invention relates to an industrial dust-collector with innovatory features, and more particularly to an industrial dust-collector which can efficiently collect solid industrial waste in a dust-collecting bag and can be conveniently operated for the bag of solid industrial waste to be taken out for retrieve and treatment, so as to save time and labor.

2. Brief Description of the Prior Art

At present, in common factories, raw materials,such as plastic grains, soya beans, or metal scraps will fall on the ground while machines being operated. These solid industrial waste must be disposed by industrial dust-collectors.

Referring to FIG. 1, a conventional industrial dust-collector is composed by a main body 10, an upper cover 101, a motor 102, a fan 103, a filtering device 104 and a floating ball 105. The upper cover 101 is installed on the top of the main body 10, the motor 102 under the upper cover 101, the fan 103 under the motor 102, and the filtering device 104 and the floating ball 105 under the fan 103.

Referring to FIG. 2, while being operated, the motor 102 and the fan 103 of the conventional dust-collector are started to suck the solid industrial waste 106 through the suction pipe 107 to the chamber 108 inside the main body 10. When the collected solid industrial waste 106 reaches a certain height, the cover 101 is opened for the solid industrial waste 106 to be dumped or shoveled, as shown in FIG. 3.

However, there are following drawbacks in the above-described structure and operation of the conventional industrial dust-collector 1. When the chamber inside the main body is filled with solid industrial waste, it is necessary to open the upper cover to dump or shovel the solid industrial waste. Since the main body is considerably weighty, it takes time and pain to do so.

2. It wastes time and labor to retrieve and treat the dumped solid industrial waste.

SUMMARY OF THE INVENTION

Therefore, the objective of the present invention is to provide an industrial dust-collector that can substantially obviate the drawbacks of the related conventional industrial dust-collector.

An objective of the present invention is to provide an industrial dust-collector that can efficiently collect solid industrial waste in a dust-collecting bag.

Another objective of the present invention is to provide an industrial dust-collector which can be conveniently operated for the bag of solid industrial waste to be taken out for retrieve and treatment, so as to save time and labor.

Accordingly, an industrial dust-collector in the present invention is provided with an air blower in the bottom of the base. An air-inlet line and an air-out line are provided at the front of the air blower. A cover is provided on the top of the base, a sucking pipe is provided at the top of the cover, and both sides of the cover are respectively provided with a buckle article. A door and a pushing rod are provided at the exterior of the base. The characteristic lies in that an air-guiding block is provided in the bottom of the cover, a plurality of air-guiding holes are provided in the bottom of air-guiding block, an elastic ring is provided at the bottom of the air-guiding block to secure the top section of a dust-collecting bag and a sleeve tube, the sleeve tube is hollow, and a plurality of through holes are provided around the sleeve tube.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
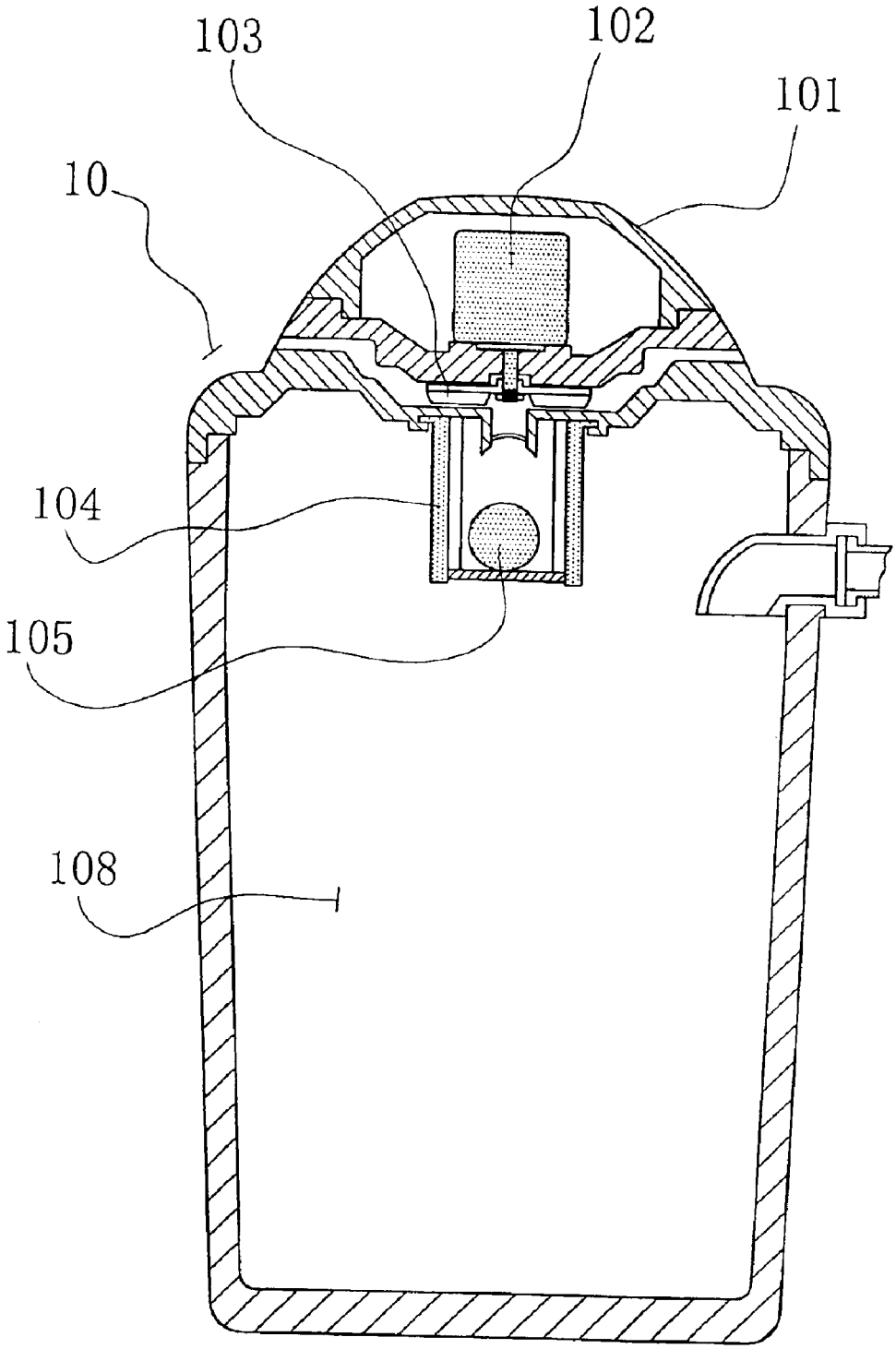
FIG. 1 (PRIOR ART)
FIG. 1 is a sectional view of a conventional industrial dust-collector in assembled configuration.
Figure 3:
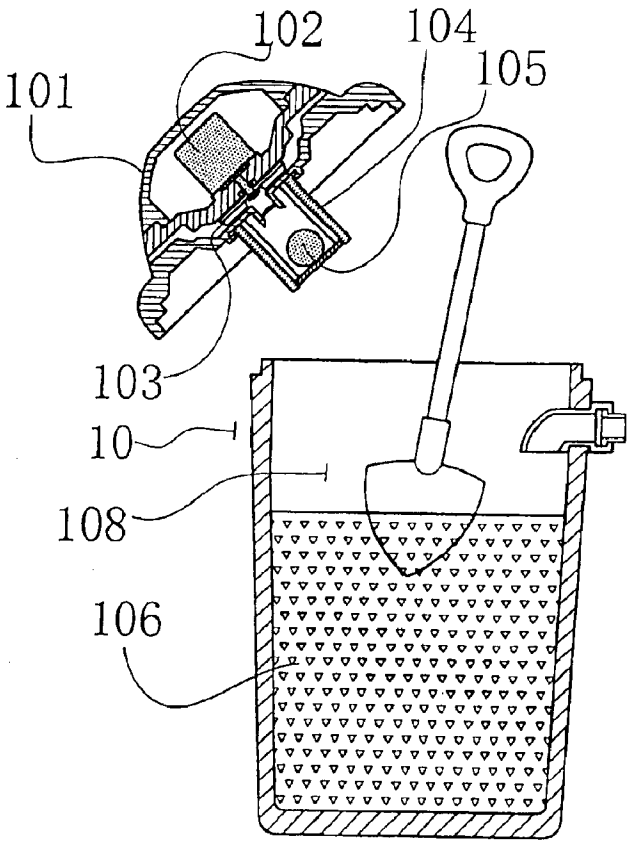
FIG. 3 (PRIOR ART)
FIG. 3 is a schematic sectional view showing the cover of a conventional industrial dust-collector being opened for the solid industrial waste to be treated with a shovel.
Figure 2:
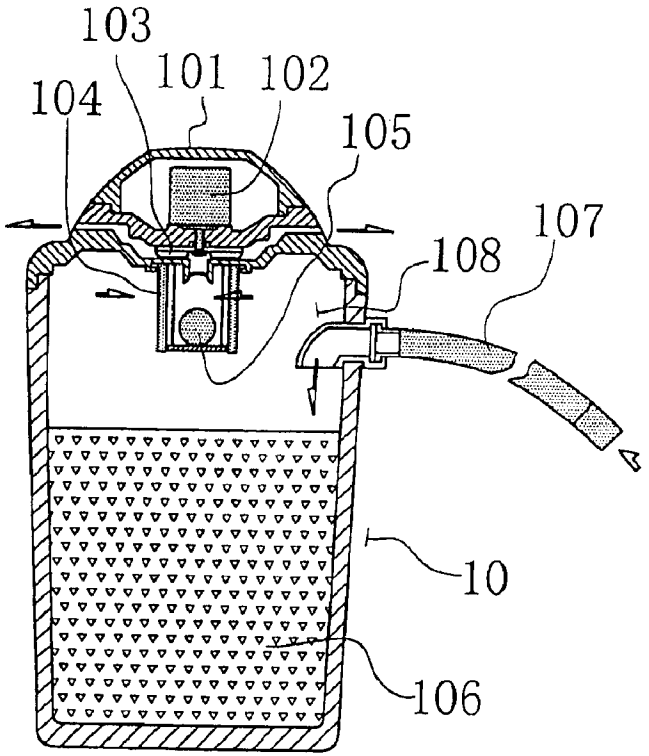
FIG. 2 (PRIOR ART)
FIG. 2 is a schematic sectional view of a conventional industrial dust-collector in assembled configuration.
Figure 4:
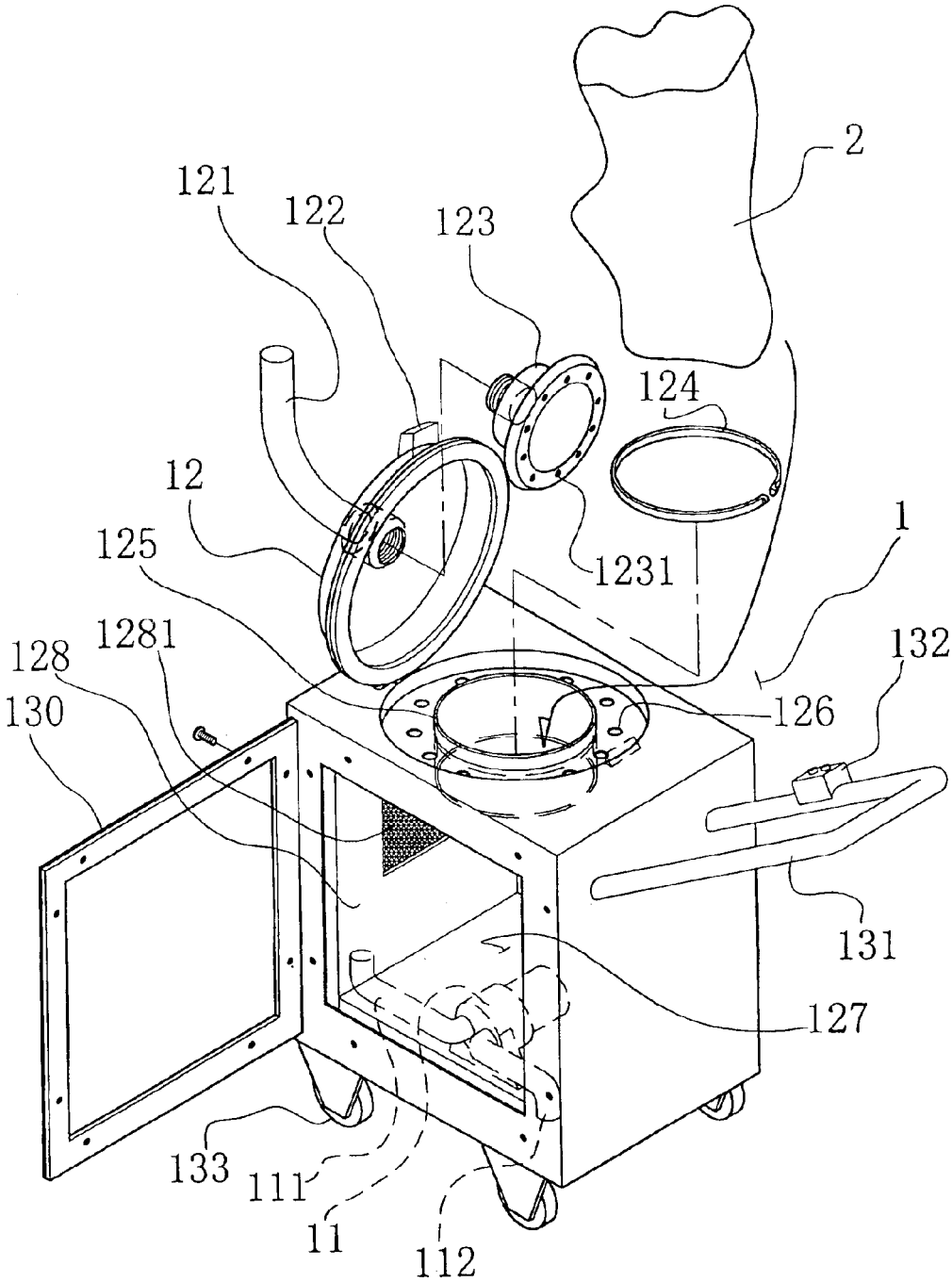
FIG. 4 is a perspective exploded view of an embodiment of the industrial dust-collector in accordance with the present invention.
Figure 5:
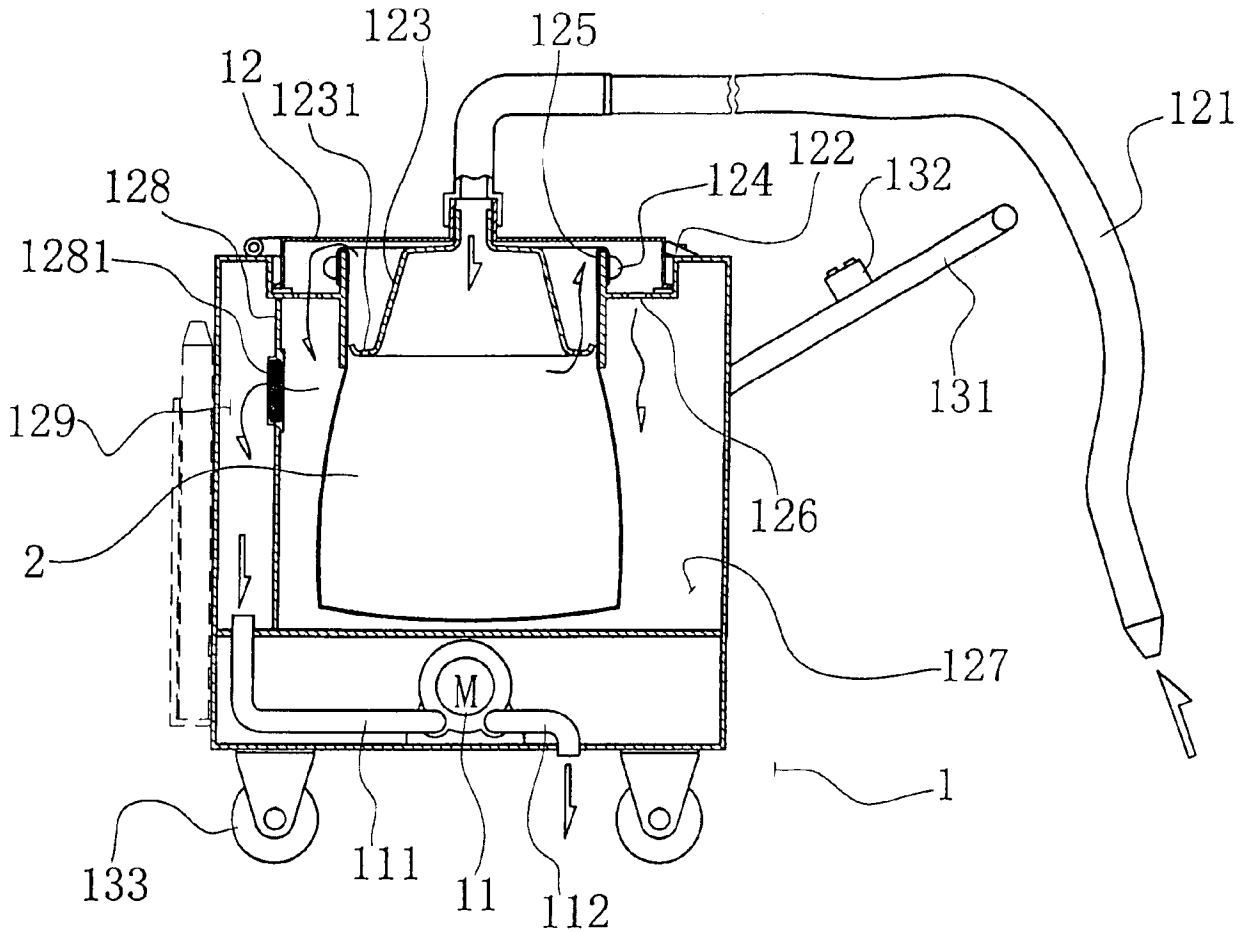
FIG. 5 is a schematic sectional view of an embodiment of the industrial dust-collector in assembled configuration in accordance with the present invention.

Referring to FIGS. 4 and 5, an embodiment of the industrial dust-collector in the present invention is provided with an air blower 11 in the bottom of the base 1. An air-inlet line 111 and an air-out line 112 are provided at the front of the air blower 11. A cover 12 is provided on the top of the base 1, a sucking pipe 121 is provided at the top of the cover 12, and both sides of the cover 12 are respectively provided with a buckle article 122. The characteristic lies in that an air-guiding block 123 is provided in the bottom of the cover 12, a plurality of air-guiding holes 1231 are provided in the bottom of the air-guiding block 123, an elastic ring 124 is provided at the bottom of the air-guiding block 123 to secure the top section of a dust- collecting bag 2 and a sleeve tube 125, the sleeve tube 125 is hollow, and a plurality of through holes 126 are provided around the sleeve tube 125.

A partition plate 128 is provided at one side of the inner room 127 of the base 1, a filtering device 1281 is provided in the partition plate 128, and a small room 129 is formed at one side of the partition plate 128. The base 1 is provided with a door 130 and a pushing rod 131 at the exterior, a switch device 132 is provided on the pushing rod 131, and wheels 133 are provided at the bottom of the base 1.

Figure 8:
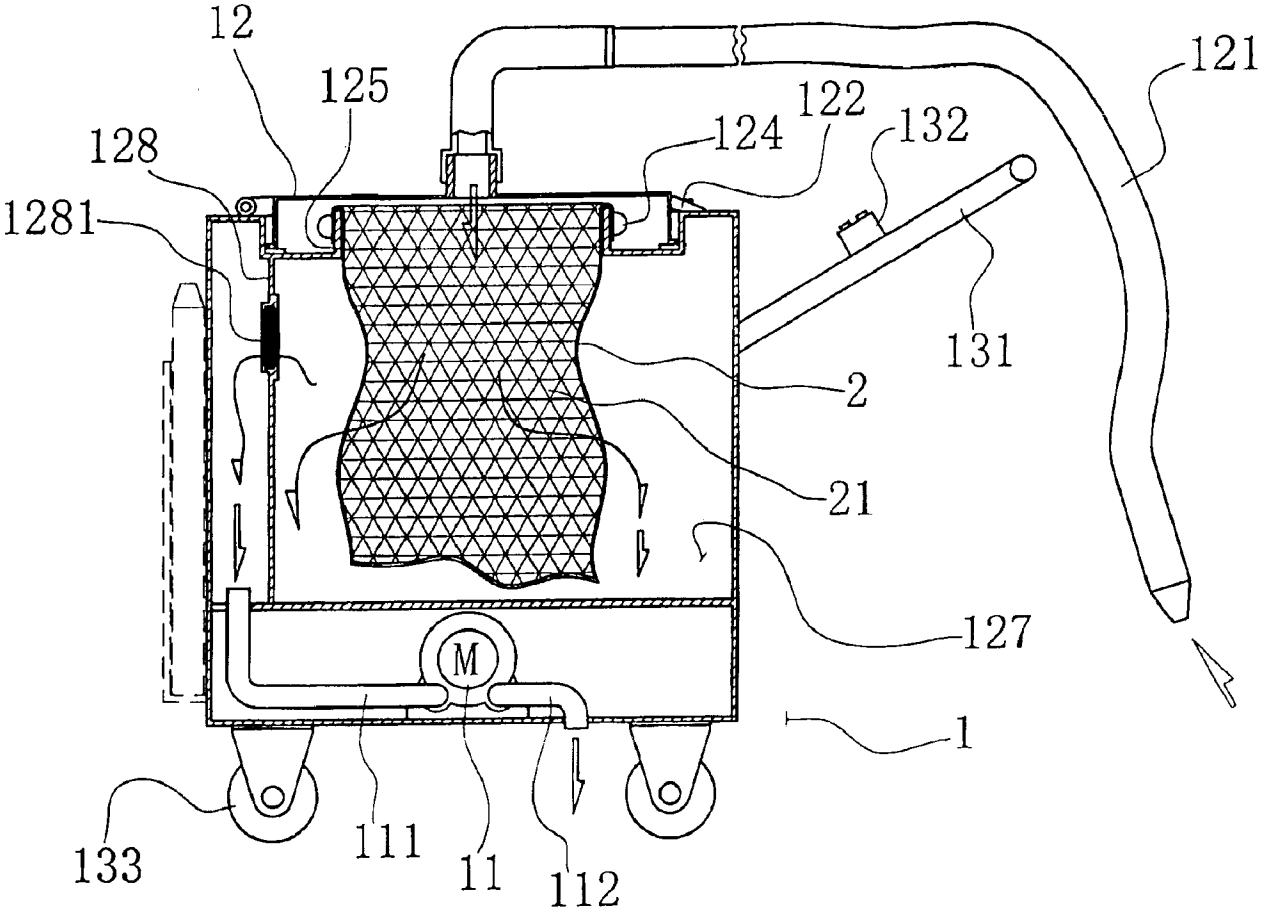
FIG. 8 is a schematic sectional view of another embodiment of the industrial dust-collector in accordance with the present invention whose dust-collecting bag is provided with ventilating holes; and, FIG. 9 is a schematic sectional view of another embodiment of the industrial dust-collector in accordance with the present invention connecting with a conventional dust-collector.

Referring to FIG. 8, another embodiment of the industrial dust-collector in the present invention is provided with an air blower 11 in the bottom of the base 1. An air-inlet line 111 and an air-out line 112 are provided at the front of the air blower 11. A cover 12 is provided on the top of the base 1, a sucking pipe 121 is provided at the top of the cover 12, and both sides of the cover 12 are respectively provided with a buckle article 122. The characteristic lies in that an elastic ring 124 is provided at the bottom of the cover 12 to secure the top section of a dust-collecting bag 2 and a sleeve tube 125, the dust-collecting bag 2 is provided with ventilating holes 21, and the sleeve tube 125 is hollow.

A partition plate 128 is provided at one side of the inner room 127 of the base 1, a filtering device 1281 is provided in the partition plate 128, and a small room 129 is formed at one side of the partition plate 128. The base 1 is provided with a door 130 and a pushing rod 131 at the exterior, a switch device 132 is provided on the pushing rod 131, and wheels 133 are provided at the bottom of the base 1.

While being assembled, referring to FIG. 5, the dust-collecting bag 2 is placed in the inner room 127 of the base 1, the head section of the dust-collecting bag 2 is turned outward to sleeve on the the sleeve tube 125, and then the elastic ring 124 is sleeved on the sleeve tube 125 to firmly secure the head section of the dust-collecting bag 2, so as to prevent the head section of the dust-collecting bag 2 from falling off. The air-guiding block 123 is fixed to the cover 12, and then the cover 12 is buckled on the top of the base 1.

Figure 6:
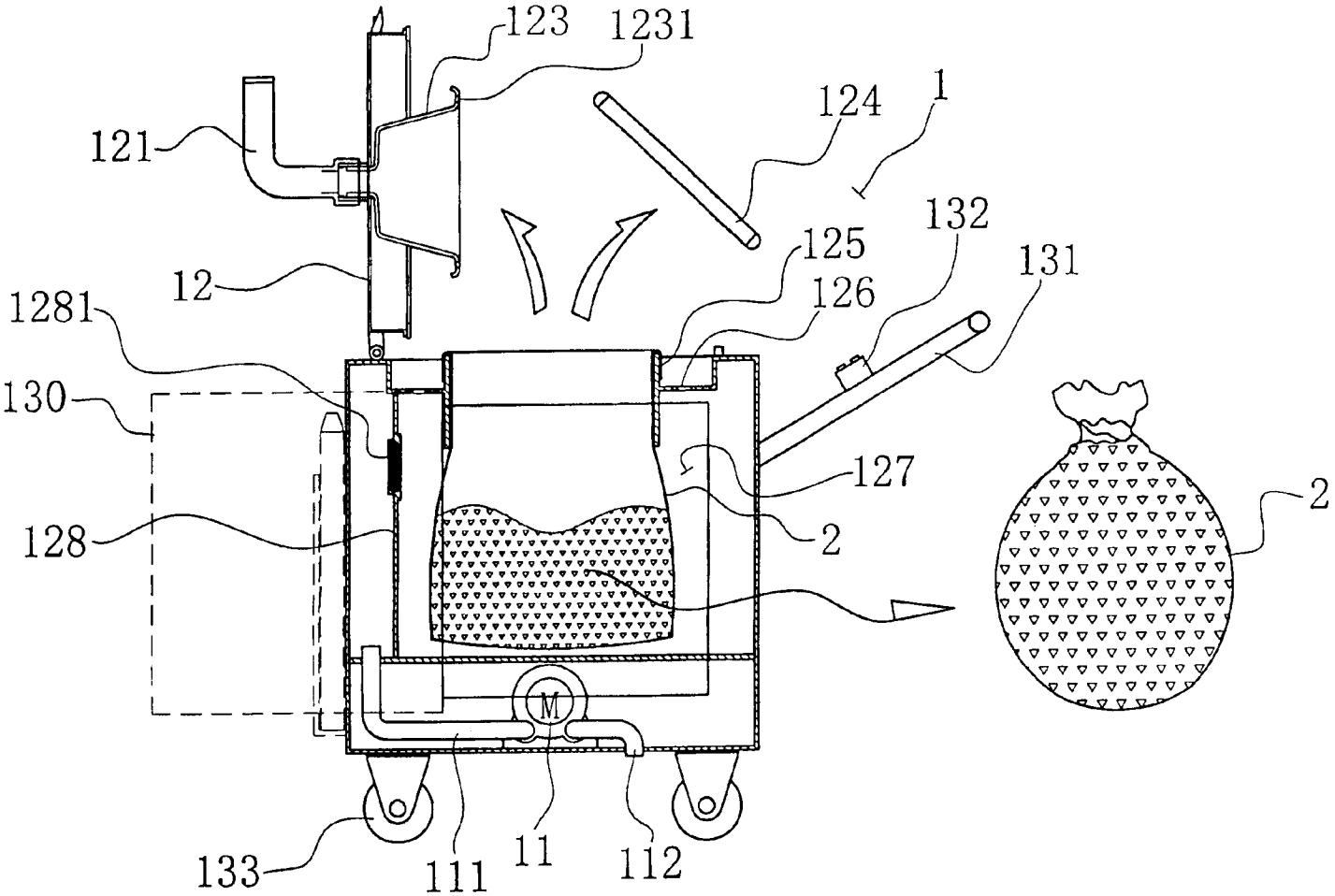
FIG. 6 is a schematic view of an embodiment of the industrial dust-collector in accordance with the present invention showing the cover and the door being opened for a bag of solid industrial waste to be taken out for treatment.

When the switching device is switched on to start the motor M to make the air blower 11 operate, the inner room 127 will become vacuum by the strong suction of the air-inlet line 111, so as for the sucking pipe 121 to suck solid impurities into the dust-collecting bag 2. The air will flow outward the air-guiding holes 1231 of the air-guiding block 123 and then flow through the through holes 126 of the sleeve tube 125 into the inner room 127, and the dust of the air will be filtered and blocked by the filtering device 1281 in the partition plate 128, so as for the air to be sucked in the air-inlet line 111 and to be eliminated from the air-out line 112. When the dust-collecting bag 2 is full, the cover 12 is opened for the elastic ring 124 to be taken off, and the door 130 is opened for the dust-collecting bag 2 to be taken out, as shown in FIG. 6.

Figure 7:
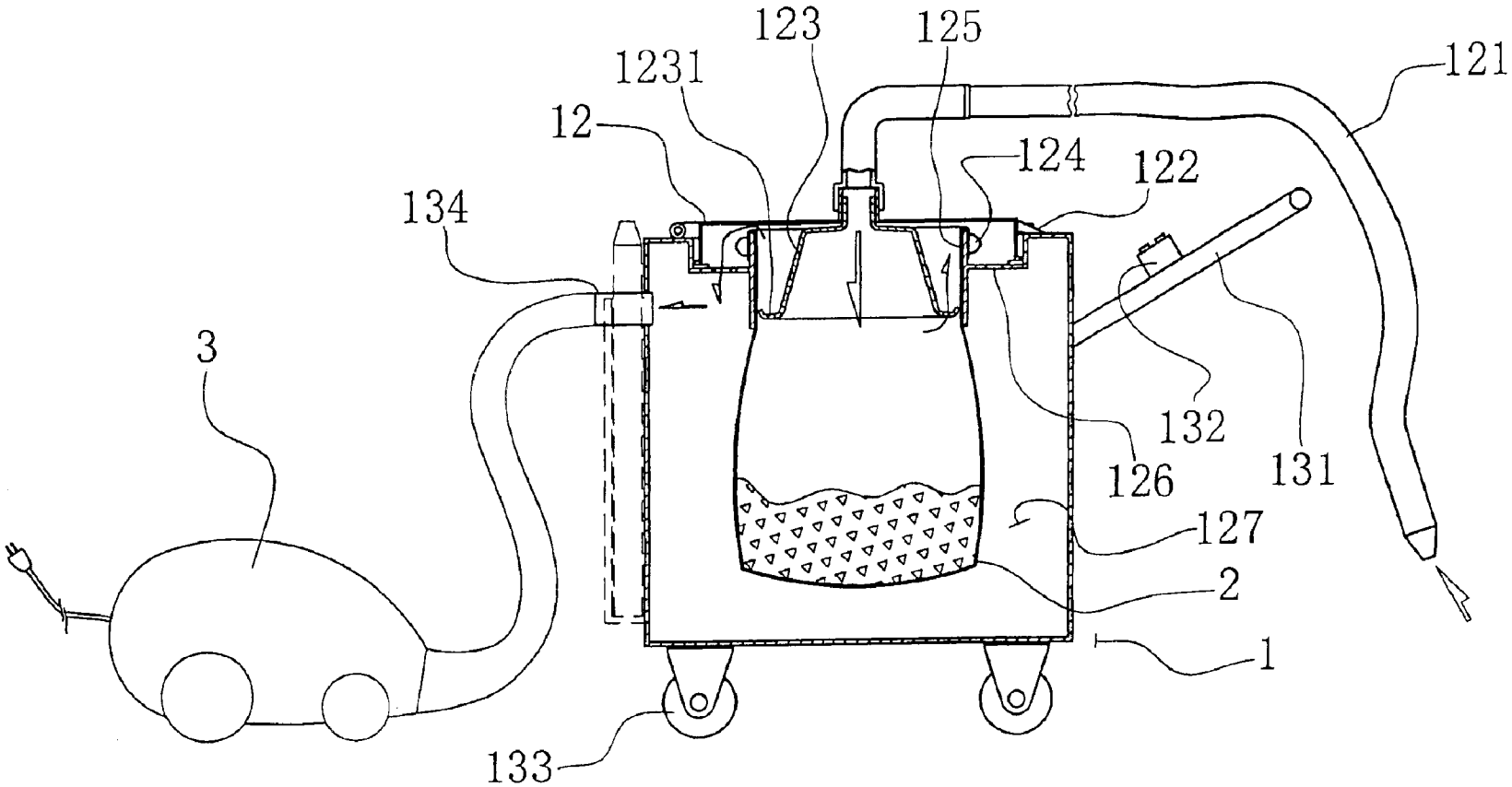
FIG. 7 is a schematic sectional view of an embodiment of the industrial dust-collector in accordance with the present invention connecting with a conventional dust-collector.

Referring to FIG. 7, a through pipe 134 is provided at one outer side of the base 1, and the through pipe 134 can connect with the sucking pipe of a conventional dust-collector 3. While being operated, the conventional dust-collector 3 is started to produce suction, the inner room 127 will be vacuum, and the sucking pipe 121 will suck solid impuralities into the dust-collecting bag 2. The air will flow outward the air-guiding holes 1231 of the air-guiding block 123 and then flow through the through holes 126 of the sleeve tube 125 into the inner room 127, and then the air will flow through the through pipe 134 into the sucking pipe of the conventional dust-collector 3. It has the same effect as that of above-mentioned.

While another embodiment of the industrial dust-collector in the present invention being assembled, the dust-collecting bag 2, which is provided with ventilating holes 21, is placed in the inner room 127 of the base 1, the head section of the dust-collecting bag 2 is turned outward to sleeve on the the sleeve tube 125, and the elastic ring 124 is sleeved on the sleeve tube 125 to firmly secure the head section of the dust-collecting bag 2, so as to prevent the head section of the dust-collecting bag 2 from falling off. The cover 12 is buckled on the top of the base 1.

Referring to FIG. 8, while another embodiment of the industrial dust collector in the present invention being operated, the switching device is switched on to start the motor M to make the air blower 11 operate, the inner room 127 will become vacuum by the strong suction of the air-inlet line 111, so as for the sucking pipe 121 to suck solid impurities into the dust-collecting bag 2. The air will flow outward the ventilating holes 21 of the dust-collecting bag 2, and the dust of the air will be filtered and blocked by the filtering device 1281 in the partition plate 128, so as for the air to be sucked the air-inlet line 111 and to be eliminated from the air-out line 112. When the dust-collecting bag 2 is full, the cover 12 is opened for the elastic ring 124 to be taken off, and the door 130 is opened for the dust-collecting bag 2 to be taken out.

Figure 9:
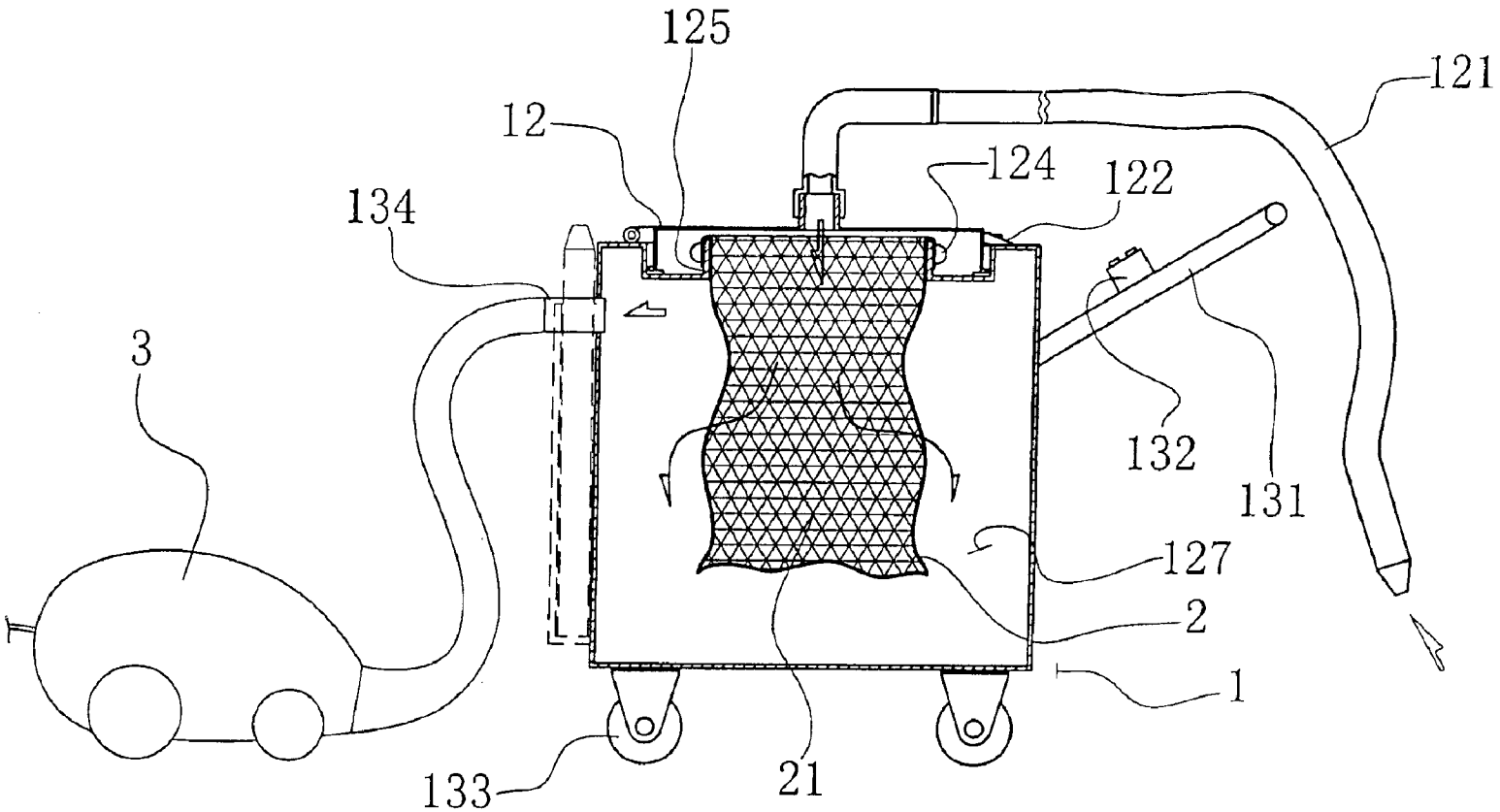

Referring to FIG. 9, a through pipe. 134 is provided at one outer side of the base 1 of another embodiment of the present invention, and the through pipe 134 can connect with the sucking pipe of a conventional dust-collector 3. While being operated, the conventional dust-collector 3 is started to produce suction, the inner room 127 will be vacuum, and the sucking pipe 121 will suck solid impuralities into the dust-collecting bag 2. The air will flow outward the ventilating holes 21 of the dust-collecting bag 2, and then the air will flow through the through pipe 134 into the sucking pipe of the conventional dust-collector 3. It has the same effect as that of above-mentioned.

While the preferred embodiments of the invention have been described above, it will be recognized and understood that various modifications may be made therein, and the appended claims are intended to cover all such modifications which may fall within the spirit and scope of the invention.

What is claimed is:

1. An industrial dust-collector being provided with an air blower in the bottom of a base, an air-inlet line and an air-out line being provided at the front of said air blower, a cover being provided on the top of said base, a sucking pipe being provided at the top of said cover, sides of said cover respectively being provided with a buckle article, said base being provided with a door and a pushing rod at the exterior, a switch device being provided on said pushing rod;

said industrial dust-collector comprising:

an air-guiding block provided in the bottom of said cover, a plurality of air-guiding holes being provided in the bottom of said air-guiding block;

an elastic ring being provided at the bottom of said air-guiding block to secure the top section of a dust-collecting bag and a sleeve tube;

a dust-collecting bag being provided in the inner room of said base; and, a sleeve tube being hollow, through holes being provided around said sleeve tube, wherein environmental air containing particulate matter is drawn into said industrial dust-collector and said particulate matter is collected in said dust-collecting bag, said environmental air being drawn out of said dust-collecting bag through said air-guiding holes of said air-guiding block.

2. The industrial dust-collector as recited in claim 1, wherein a partition plate is provided at one side of the inner room of said base, a filtering device is provided in said partition plate, and a small room is formed at one side of said partition plate.

3. The industrial dust-collector as recited in claim 1, wherein a through pipe may be provided at one outer side of said base, and said through pipe may connect with the sucking pipe of a conventional dust-collector.

4. The industrial dust-collector as recited in claim 1, wherein wheels are provided at the bottom of said base.

5. An industrial dust-collector being provided with an air blower in the bottom of a base, an air-inlet line and an air-out line being provided at the front of said air blower, a cover being provided on the top of said base, a sucking pipe being provided at the top of said cover, sides of said cover respectively being provided with a buckle article, said base being provided with a door and a pushing rod at the exterior, a switch device being provided on said pushing rod;

said industrial dust-collector comprising:

an elastic ring being provided at the bottom of said cover to secure the top section of a dust-collecting bag and a sleeve tube;

an air-guiding block provided in the bottom of said cover, a plurality of air-guiding holes being provided in the bottom of said air-guiding block, a dust-collecting bag being provided in the inner room of said base; and, a sleeve tube being hollow, wherein environmental air containing particulate matter is drawn into said industrial dust-collector and said particulate matter is collected in said dust-collecting bag, said environmental air being drawn out of said dust-collecting bag through said air-guiding holes of said air-guiding block.

6. The industrial dust-collector as recited in claim 5, wherein a partition plate is provided at one side of the inner room of said base, a filtering device is provided in said partition plate, and a small room is formed at one side of said partition plate.

7. The industrial dust-collector as recited in claim 5, wherein a through pipe may be provided at one outer side of said base, and said through pipe may connect with the sucking pipe of a conventional dust-collector.

8. The industrial dust-collector as recited in claim 5, wherein wheels are provided at the bottom of said base.

9. The industrial dust-collector as recited in claim 5, wherein said dust-collecting bag is provided with ventilating holes.

* * * * *